US009873058B2

(12) United States Patent
Magrath, III

(10) Patent No.: US 9,873,058 B2
(45) **Date of Patent: *Jan. 23, 2018**

(54) RIDE VEHICLE AND AMUSEMENT ATTRACTION

(71) Applicant: AMUSEMENT PRODUCTS LLC, Chattanooga, TN (US)

(72) Inventor: Earl Knight Magrath, III, Chattanooga, TN (US)

(73) Assignee: Amusement Products LLC, Chattanooga, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/218,586

(22) Filed: Mar. 18, 2014

(65) Prior Publication Data

US 2015/0265933 A1 Sep. 24, 2015

(51) Int. Cl.
*A63G 25/00* (2006.01)
*A63G 33/00* (2006.01)
*A63G 31/16* (2006.01)

(52) U.S. Cl.
CPC ..... *A63G 25/00* (2013.01); *A63G 31/16* (2013.01); *A63G 33/00* (2013.01)

(58) Field of Classification Search
CPC ..... A63G 31/00
See application file for complete search history.

(56) References Cited

U.S. PATENT DOCUMENTS 3,189,343 A * 6/1965 Beirer, Jr. ..... 472/42
5,114,154 A * 5/1992 Sellner ..... A63H 5/04 273/367
5,382,026 A * 1/1995 Harvard ..... A63F 9/0291 463/30
5,527,221 A * 6/1996 Brown ..... A63G 21/08 104/78
5,759,107 A * 6/1998 Nagel ..... 472/47
5,906,542 A * 5/1999 Neumann ..... A63F 9/0291 463/52
5,911,634 A * 6/1999 Nidata ..... A63F 13/08 434/55
2007/0020587 A1* 1/2007 Seymore ..... G09B 9/02 434/29
2010/0147609 A1* 6/2010 Gorgas ..... A63G 25/00 180/65.51

* cited by examiner

*Primary Examiner* — Michael Dennis
(74) *Attorney, Agent, or Firm* — Muncy, Giessler, Olds & Lowe, P.C.

(57) ABSTRACT

A vehicle includes a platform, a passenger seat supported above the platform, a pair of drive tires positioned on the platform and a pair of independent drive motors respectively connected to the pair of drive tires. The vehicle may further include a ride controller for controlling the pair of independent drive motors and the pair of drive tires. Additionally, the vehicle may include a laser gun mounted thereon and incorporated into a system including a target that is targetable by the laser gun.

19 Claims, 8 Drawing Sheets

RIDE VEHICLE AND AMUSEMENT ATTRACTION

BACKGROUND OF THE INVENTION

Field of the Invention

The present invention relates to amusement rides and more particularly to an amusement ride vehicle operable by a driver or a controller to provide increased freedom of movement.

Description of the Background Art

A range of games has become popular in which a player is equipped with a gun/handset that contains a laser light source. Each player wears a target mounted on the chest and/or back, which contains an apparatus to detect the light source emitted from the gun/handset of another player. A game is played in which a player scores points by shooting another player's target.

Additionally, user operated amusement vehicles have been developed in which a similar laser is mounted on a vehicle. The vehicle is operable to move so that the user may shoot targets with the vehicle mounted laser gun.

In the conventional vehicles, the control of movement of the vehicle is limited or controlled by a computer and not driver controlled. Furthermore, the position of the vehicle mounted laser gun is static or hand held. There is currently a need for a vehicle and system that provides an enhanced experience for the user by providing increased freedom of movement of operation. Furthermore, there is a need for a more dynamic way to mount and control the laser shooting device so that the game can be three dimensional.

SUMMARY OF THE INVENTION

In view of the foregoing and other exemplary problems, drawbacks, and disadvantages of the conventional methods and structures, an exemplary feature of the present invention is to provide a vehicle and system that provides an enhanced experience for the user by providing increased freedom of movement of operation.

According to a first non-limiting, exemplary aspect of the invention a vehicle includes a platform, a passenger seat supported above the platform, a pair of drive tires positioned on the platform and a pair of independent drive motors respectively connected to the pair of drive tires.

The independent drive motors and drive tires provide increased freedom of movement for the vehicle. That is, the independent drive motors allow the vehicle to drive forward and backward and to turn and/or rotate. Specifically, the vehicle is able to be rotated 360° in any direction.

According to another aspect of the present invention, the vehicle may include a transponder configured to receive operational control commands. Accordingly, the vehicle may be controlled by a passenger/driver or may be operated without passenger/driver control.

According to another exemplary aspect of the invention, the passenger seat is rotatably supported above the platform. Accordingly, additional freedom of movement is provided by configuring the passenger seat to be rotatable. That is, the passenger seat may rotate (i.e., flip) 360° such that the passenger seat may face forward, backward, upward and/or downward.

According to a second non-limiting, exemplary aspect of the invention a vehicle includes a passenger seat supported above the platform, a pair of drive tires positioned on the platform, a pair of independent drive motors respectively connected to the pair of drive tires, and a ride controller for controlling the pair of independent drive motors and the pair of drive tires.

According to a third non-limiting, exemplary aspect of the invention a system includes a vehicle and a target. The vehicle includes a platform, a passenger seat supported above the platform, a pair of drive tires positioned on the platform, a pair of independent drive motors respectively connected to the pair of drive tires, and a laser gun mounted on the passenger seat. The target is targetable by the laser gun.

The vehicle and system according to the above exemplary aspects of the invention provide increased user amusement and flexibility in use of the vehicle. That is, the vehicle and system may be used in several different modes. Specifically, the vehicle may be used in a ride mode, in which the vehicle is operated by a controller to maneuver the vehicle and passenger through a variety of maneuvers. Alternatively, the vehicle may be used in a driving mode in which the passenger/driver operates the vehicle through a variety of vehicle maneuvers. Additionally, the vehicle may be used within the system described above as part of a laser gun game.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, do not limit the present invention, and wherein.

DETAILED DESCRIPTION

Figure 1:
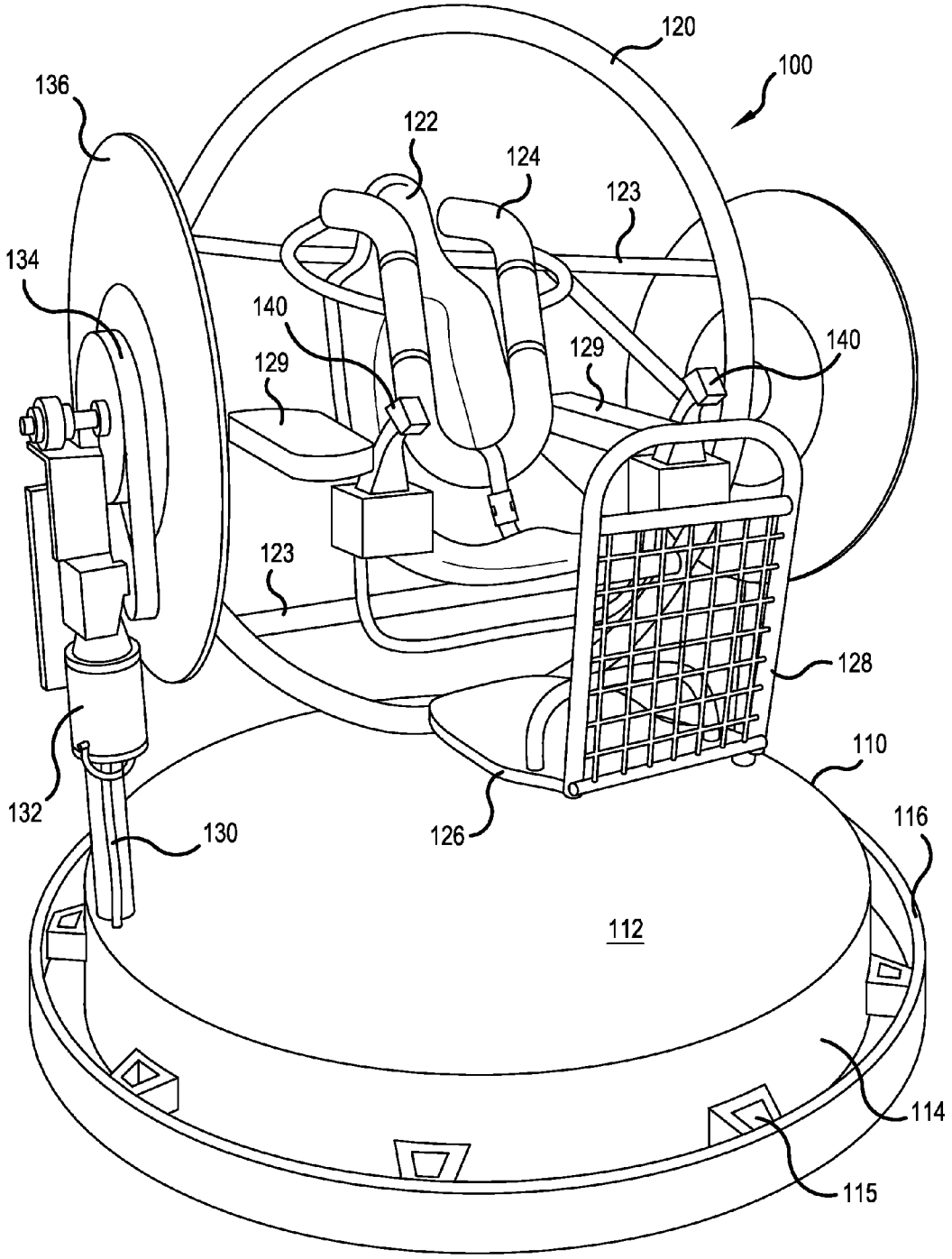
FIG. 1 illustrates a front perspective view of a vehicle 100 according to an exemplary, non-limiting embodiment of the present invention.

Referring now to the drawings, and more particularly to FIGS. 1-10, there are shown exemplary embodiments of the present invention.

FIG. 1 illustrates a vehicle 100 according to certain exemplary embodiments of the present invention. The vehicle 100 includes a drive platform 110. In the exemplary embodiment illustrated in FIG. 1, the drive platform 110 has a circular base 114 with a flat, circular top surface 112. Furthermore, a bumper 116 is disposed around the circular base 114. The bumper 116 is mounted on the circular base 114 by a plurality of attachment members 115 disposed around the circular base 114. The bumper 116 is spaced apart from the circular base 114 such that a gap is disposed between the bumper 116 and the circular base 114. In the exemplary embodiment illustrated in FIG. 1, the bumper 116 comprises a circular ring disposed 360° around an entire circumference of the circular base 114.

A passenger seat 122 is disposed above the platform 110. The passenger seat 122 is suspended above the top surface 112 of the platform 114. The passenger seat 122 is supported by a frame 120. In the exemplary embodiment illustrated in FIG. 1, the frame 120 includes a circular ring body surrounding and supporting the passenger seat 122. The frame 120 also includes two cross beams 123, which extend across the frame 120, to mount the passenger seat 122 to the frame 120. The frame 120 is mounted above the platform 110 by two vertically disposed supports 130 disposed on opposite sides of the platform 110. The frame 120 is rotationally mounted on the two vertically disposed supports 130 by a mounting rod 127 (see FIG. 2).

Figure 6:
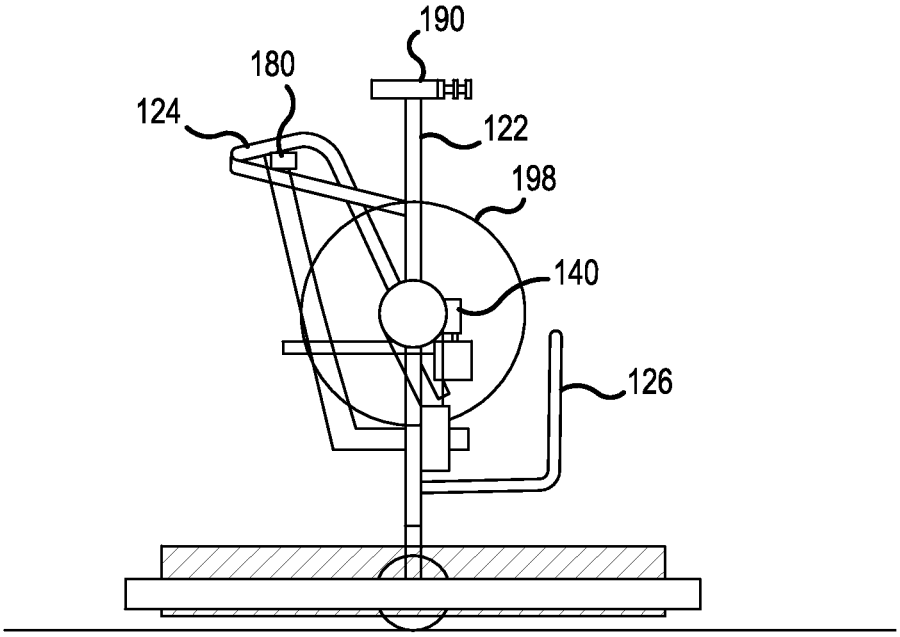
FIG. 6 illustrates a profile view of the vehicle 100 illustrated in FIG. 1.

The passenger seat 122 has a passenger harness 124 configured to secure a passenger in the passenger seat 122. A foot support 126 is mounted to the bottom of the passenger seat 122. A pair of arm rests 129 is disposed on each side of the passenger seat 122. Furthermore, as is illustrated in FIG. 6, the vehicle includes a plastic protective cover 198 positioned around the passenger seat 122 and harness 124 to cover and protected the passenger.

Figure 4A:
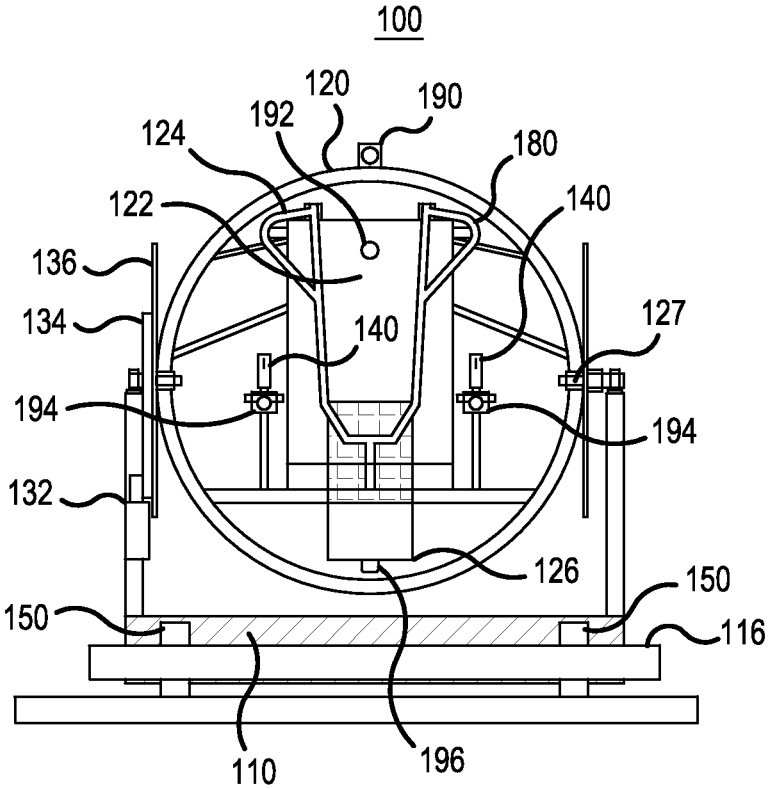
FIG. 4A illustrates a front view of the vehicle 100 illustrated in FIG. 1.
Figure 4B:
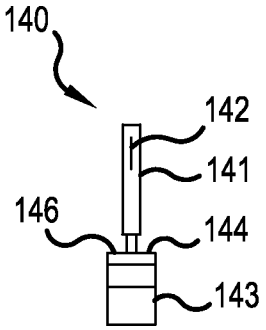
FIG. 4B illustrates a detailed view of the controller 140 for the vehicle 100.
Figure 5:
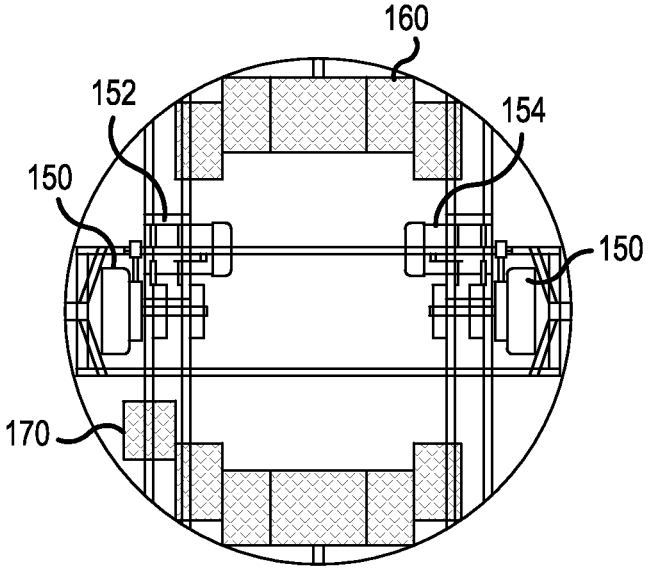
FIG. 5 illustrates a top view of a base 110 of the vehicle illustrated in FIG. 1.

A vehicle controller 140 is mounted on the passenger seat. The vehicle controller 140 is configured to allow a user/passenger to operate the vehicle 100. In the exemplary embodiment illustrated in FIG. 1, the vehicle controller 140 comprises a pair of control joysticks disposed on each of the arm rests 129. FIG. 4B illustrates the vehicle controllers 140 in detail. The vehicle controller 140 includes a movable joystick 141 mounted on a fixed base 143. The joystick 141 includes a trigger 142, with which a passenger of the vehicle can actuate a laser gun 190 (discussed below). The vehicle controller 140 also includes a set of platform controls 144 on one side of the joystick 142 and a set of frame rotation controls 146 on an opposite side of the joystick 142.

Figure 2:
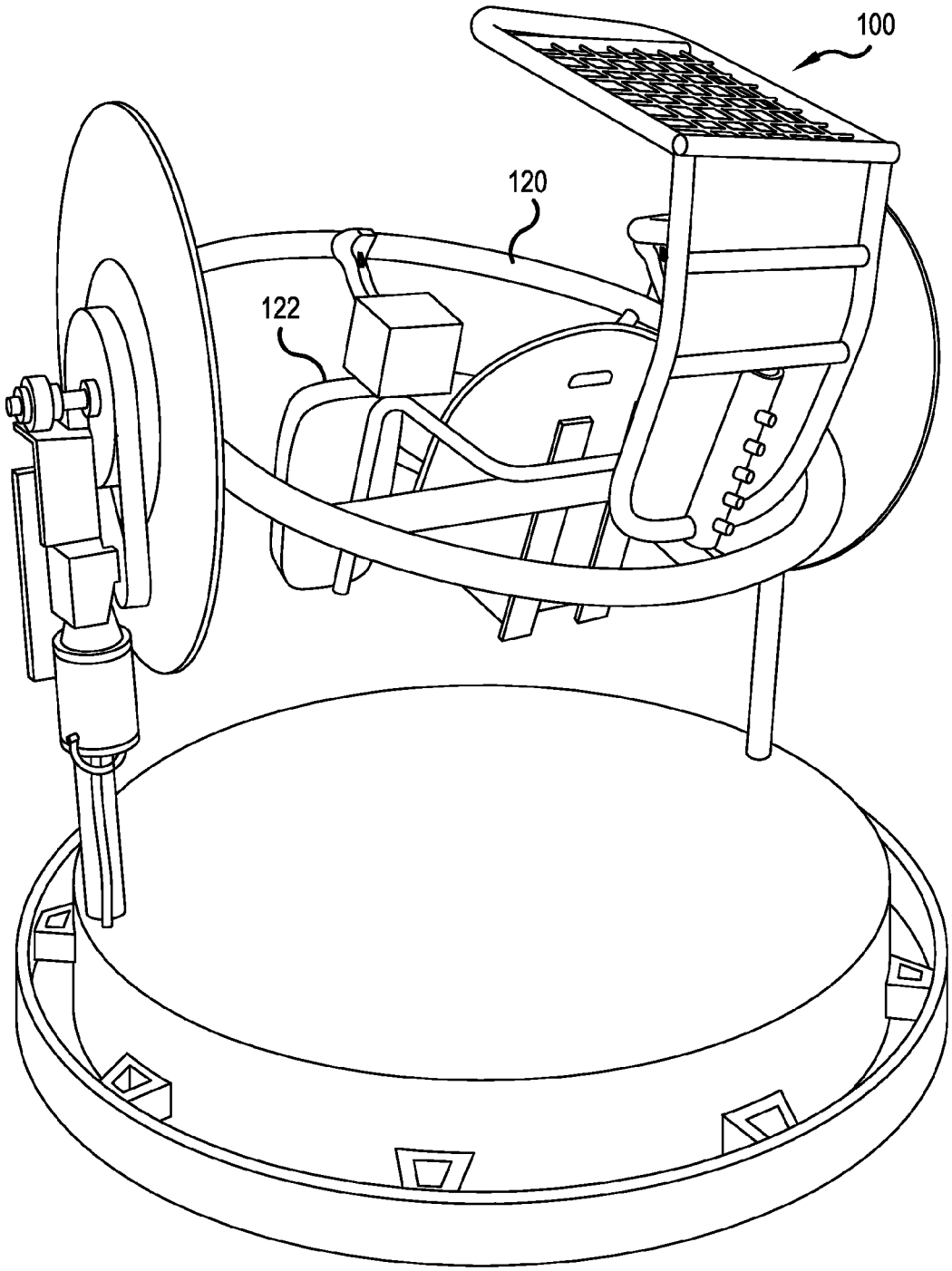
FIG. 2 illustrates a perspective view of the vehicle 100 in a first exemplary rotated position.
Figure 3:
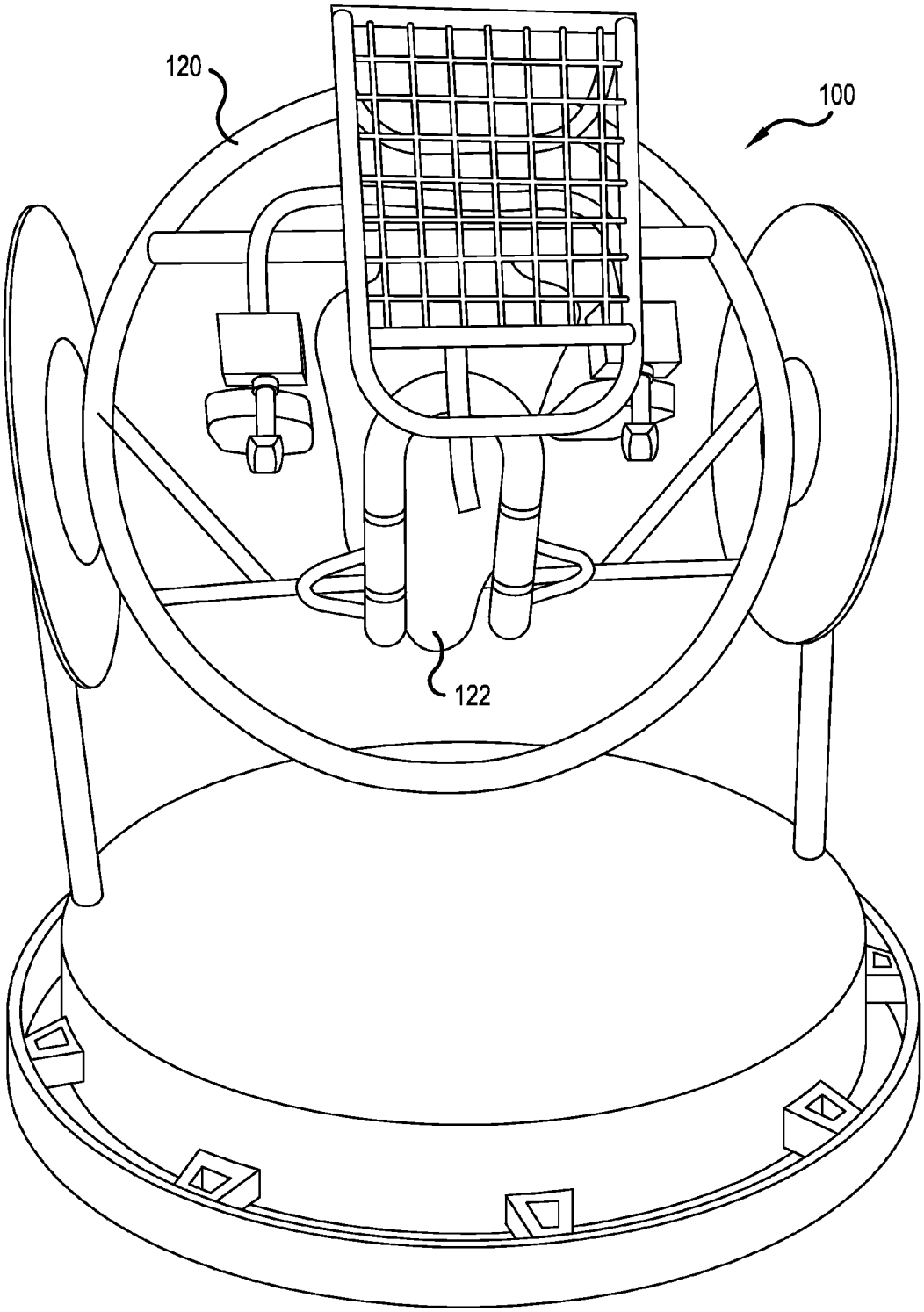
FIG. 3 illustrates a perspective view of the vehicle 100 in a second exemplary rotated position.

The vehicle 100 comprises a vertical drive system including a vertical drive motor 132 including a drive belt 134 configured to rotate the support frame 120. The vertical drive motor 132 is mounted to one of the vertical supports 130. The vertical drive motor 132 is configured to rotate the frame 120 and passenger seat 122 up to 360°. Accordingly, the passenger in the seat 122 is able to face forward, upward, backward, downward, etc. For example, as is illustrated in FIG. 2, the frame 120 and the seat 122 are rotated so that the passenger seat 122 is facing upward. As is illustrated in FIG. 3, the frame 120 and seat are rotated so that the passenger seat 122 is facing downward. Additionally, a pair of passenger guards 136 is disposed on each side of the frame 120 to protect the passenger from the movable parts of the vehicle 100.

Referring to FIGS. 4A-6, the vehicle 100 includes an independent two wheel drive system located on a central axis of the platform 110. The independent two wheel drive system includes two separate and independent drive tires 150 disposed on the central axis of the circular base 114. The drive system also includes two independent electric motors 152/154, respectively connected to each of the drive tires 150. The electric motors 152/154 independently control the drive tires 150 allowing the drive tires to move the vehicle 100 forward, backward or turn/rotate 360°. The drive tires 150 and the motors 152/154 are positioned within the circular base 114. Specifically, the drive tires 150 are mounted below the top surface 112 of the platform 110 and extend through an open bottom of the platform to a surface (i.e., the ground) below the vehicle 100. Furthermore, the drive system includes one or more battery trays 160 positioned within the base 114 underneath the platform 112 to power the motors 152/154.

The vehicle 100 also includes one or more speakers. In the exemplary embodiment illustrated in FIG. 4, the vehicle 100 includes a pair of speakers 180 disposed on each side of the passenger seat 122.

A plurality of lights (e.g., LED lights) is positioned on the seat frame 120 and the platform 110. The lights perform a variety of functions including designating teams (e.g., by color), indicating vehicle state (e.g., on/off), indicating when actions or functions have happened or been performed, and indicating active targets.

Figure 8:
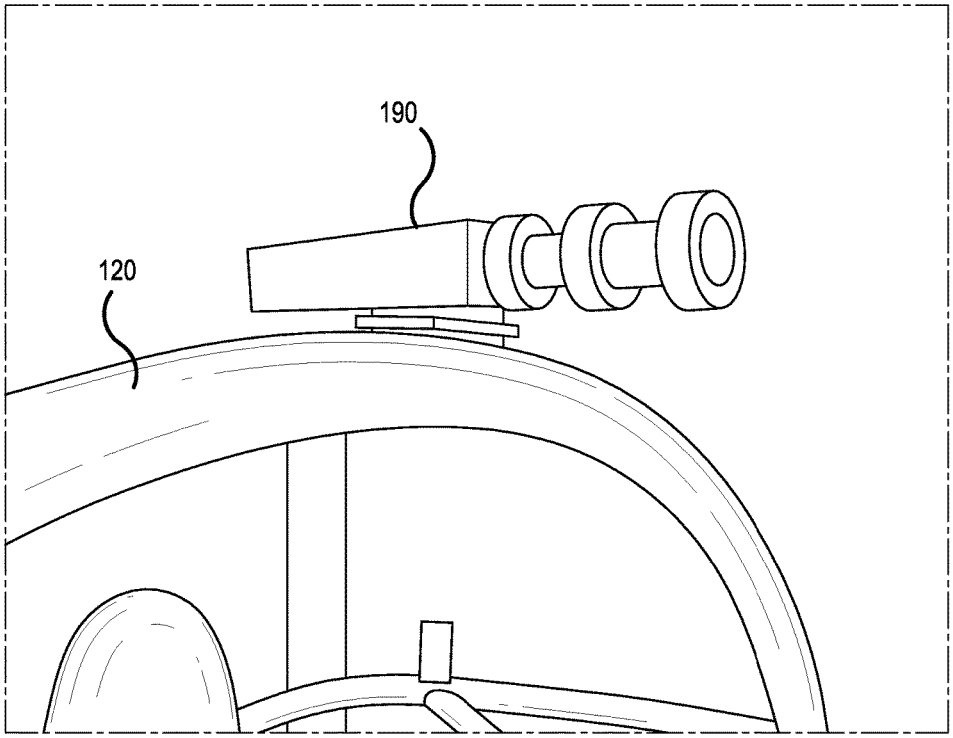
FIG. 8 illustrates a gun 190 mounted on the vehicle 100 illustrated in FIG. 1.

Additionally, in accordance with certain exemplary aspects of the invention, a laser gun 190 may be mounted on the frame 120 of the vehicle allowing the driver to tilt the seat to aim the laser gun in any direction. The laser gun 190, for example, includes an infrared light gun. Thus, the laser light emitted from the gun functions as a visual aiming tool. FIGS. 6 and 8 more clearly illustrate the laser gun 190 mounted on the frame 120.

Figure 7:
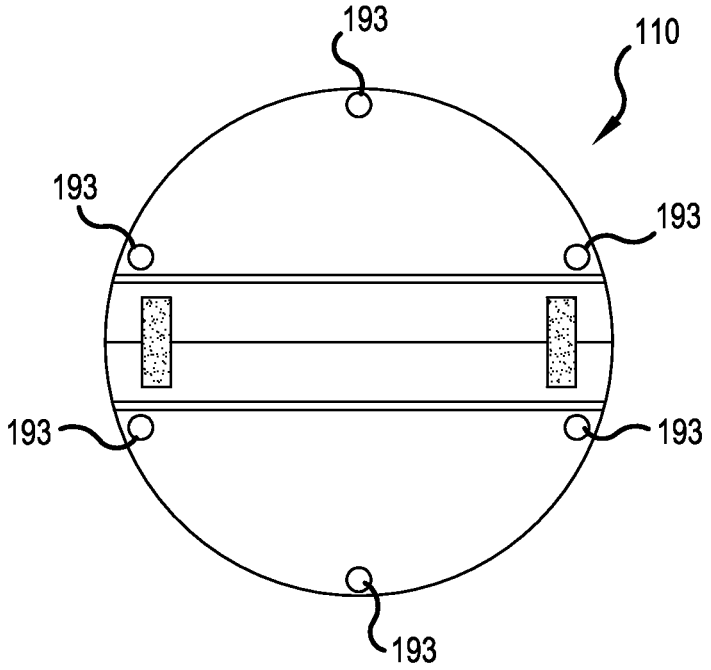
FIG. 7 illustrates an alternate view of the platform 110 of the vehicle illustrated in FIG. 1.

Furthermore, the vehicle 100 includes one or more targets configured to interact with the laser gun 190 from another vehicle. Preferably, the vehicle 100 includes a plurality of targets as illustrated in FIGS. 4A and 7. Specifically, as is illustrated in FIG. 4A, the vehicle 100 includes a rear target 192 positioned on a back of the passenger seat 122, front targets 194 positioned on or near each of the vehicle controllers 140, and a foot rest target 196 positioned on the vehicle foot rest 126. Additionally, as is illustrated in FIG. 7, the vehicle 100 includes a plurality of platform targets 193 positioned around the vehicle platform 110.

Figure 9:
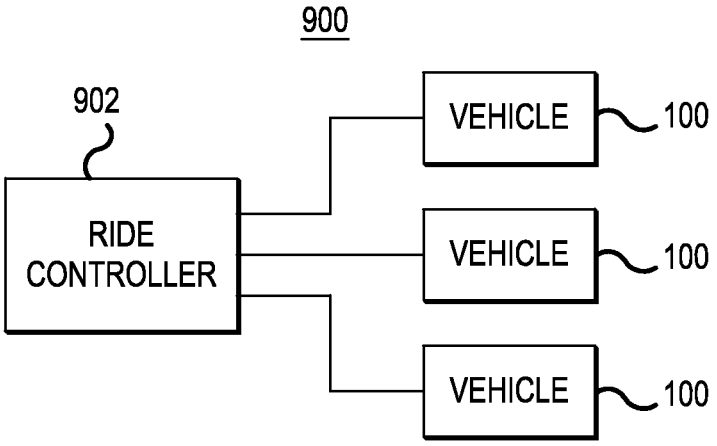
FIG. 9 illustrates a system 900 including the vehicle 100 illustrated in FIG. 1.

FIG. 9 illustrates a system 900 according to an exemplary aspect of the present invention. The system 900 includes one or more of the vehicles 100 detailed above. Additionally, the system 900 includes a ride controller 902, which communicates with the one or more vehicles 100. In the exemplary embodiment illustrated in FIG. 9, the system 900 includes a plurality of vehicles 100.

The controller 902 is configured to operate the vehicle without passenger control. Specifically, the controller is configured to start the vehicle, time the ride, and turn off the vehicle automatically when a ride attendant starts the ride. The controller 902 communicates wirelessly with each of the vehicles. During the ride, the controller 902 is able to take temporary control of any or all of the vehicles 100 and control the movement and operation of the vehicle(s). Specifically, the controller 902 can send one or all of the vehicles 100 through wireless drive commands sending the car in any direction or at any angle. Alternatively, the controller 902 may have complete control over one or more of the vehicles 100 such that the entire ride of the vehicle(s) 100 is out of the user/passenger's control. The controller 902 may use a program to run the vehicle(s) in a series of ride motions using wireless drive controls.

Furthermore, during the ride, the ride controller 902 can play music or provide voice commands through the speakers 180. Specifically, the ride controller 902 can provide a current status, scoring opportunities, scores, and a variety of ride information to the passenger during a ride or game.

The system 900 may be incorporated into an arena or designated area. Using, for example, radio-frequency identification (RFID), the controller 902 can turn on/off specific areas of the arena allowing certain things to happen when one of the vehicles reaches the specific area. For example, RFID tags can be placed in the floor for a variety of uses. For example, a tag can be placed in several areas of the floor so that when a light shines on it (blue light for example) the first vehicle to get to that spot will get shields for 30 seconds where no one can hit the vehicle sensors.

Each vehicle 100 includes a ride transponder 170 positioned within the base 114 beneath the top surface 112 of the drive platform 110. The wireless transponder 170 receives operational information from the ride controller and broadcasts the operational information back to the ride controller.

Figure 10:
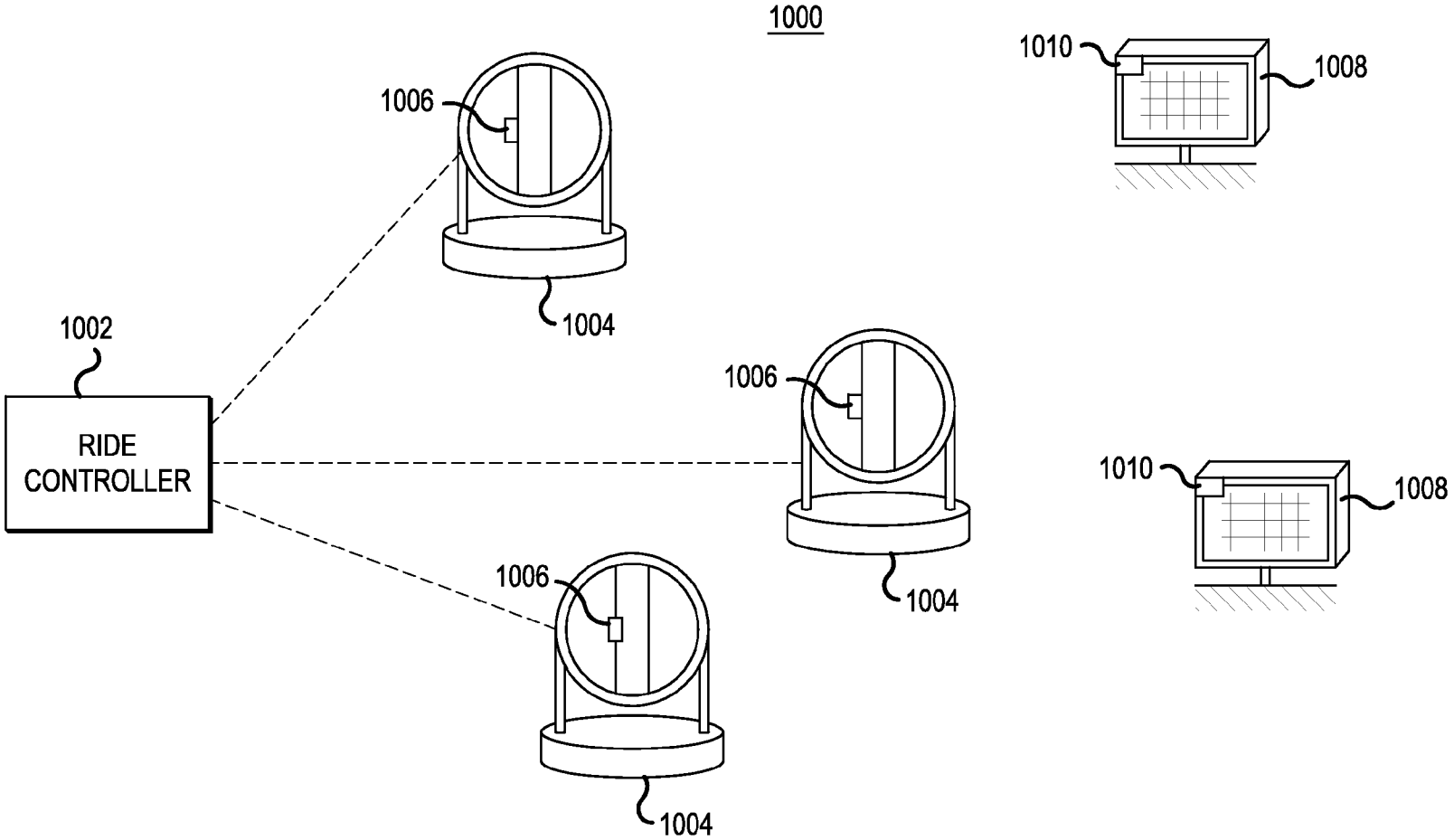
FIG. 10 illustrates an alternative system 1000 according to an exemplary aspect of the present invention.

FIG. 10 illustrates a system 1000 according to another exemplary aspect of the present invention. The system 1000 includes a ride controller 1002, which wirelessly communicates with one or more vehicles 1004 (the vehicles 1004 illustrated in FIG. 10 correspond to the vehicle 100 illustrated in FIGS. 1-8). In the embodiment illustrated in FIG. 10, the system 1000 includes a plurality of vehicles 1004. Each of the vehicles 1004 includes one or more targets 1006 disposed thereon (the targets 1006 are configured as detailed above in FIGS. 4A-7). For example, as detailed above, the target 1006 may be positioned on a back of the passenger seat 122. Alternatively, one or more targets may be positioned on the frame 120 or the drive platform 110. The system 1000 also includes one or more separate targets 1008. The separate targets 1008 may be stationary or movable.

The systems and vehicles described above may be used in several different modes. In a first exemplary mode, the vehicle(s) 100 may be used as a user operated drive platform. As a ride (e.g., amusement ride), the vehicle 100 allows the passenger to drive the vehicle to any area on a relatively flat surface. In addition, the passenger/driver can also perform tricks with the combination of the drive and flip mechanisms. That is, the passenger/driver may control the independent two wheel drive system and the vertical drive system using the vehicle controller 140. The independent two wheel drive system and the vertical drive system provide an enhanced user control system and freedom of movement allowing the user to drive the vehicle 100 while facing forward, backward, downward, upward, or while flipping. Additionally, the driver may spin the vehicle 100 with the passenger seat 122 in any position, including simultaneously flipping the passenger seat 122 and spinning the vehicle platform 110.

In a variation of the drive platform, the user operated vehicle 100 may be incorporated into a game in which points are accumulated for performing a specific trick during a specific time frame. The user may gain points by performing any of a variety of user selected tricks or a required trick communicated to the user through the ride controller 1002/1002. As detailed above, the ride controller 1002/1002 may temporarily take control of the vehicle 100 to perform a specific trick.

In another mode, the vehicle 100 may be used as a ride platform. In this mode, the operation of the vehicle 100 is completely at the control of the ride controller 1002/1002. That is, the vehicle 100 is operated entirely by the ride controller without user intervention. The controller 1002/1002 uses pre-programmed routines to make the vehicle(s) perform a variety of movements while the rider has no control of the vehicle.

In a third mode, the vehicle 100 is used in a laser gun game, incorporated in the system 1000 illustrated in FIG. 10. The vehicle 100 is operated by the user, as in the first mode described above. Additionally, a laser gun is mounted to the vehicle (e.g., on the frame 120 or seat 122) allowing the motions of the vehicle to be used to aim the laser gun. Accordingly, the laser gun can be aimed forward, backward, upward, downward, etc., by rotating the passenger seat 122 and/or the platform 110. The laser gun point in the same direction as the passenger/driver of the vehicle 100. As detailed above with respect to FIG. 10, a variety of targets 1006/1008 may be provided for the user. For example, targets 1006 may be mounted on each vehicle 100 so that multiple vehicles may attempt to shoot at one another. Additionally, separate stationary or movable targets 1008 are provided around the arena. The targets 1008 may be positioned on the walls or ceilings of the arena or may be disposed as standing targets throughout the arena playing area. The targets 1008 are targetable by the passenger/driver by driving, turning and tilting the driving platform 110 of the vehicle 100.

The targets 1008 may be turned on constantly throughout a game sequence or may be turned on/off during the game by the ride controller 1002. The targets 1008 include lights 1010 indicating when the targets 1008 are active. This allows the attraction to have a scoring component where the drivers/passengers can score points for shooting the targets 1006/1008. The game can also allow for bonus points added by scoring when the passenger seat 122 is in unique positions (e.g., upside down, etc.) for increased difficulty. Additionally, the RFID system, described above, can allow for increased points or bonus points for being in certain locations in the arena.

Moreover, in addition to scoring points, vehicle target hits can also effect an opponents vehicle. That is, when a vehicle is hit in, for example, the passenger seat targets 192/196, the frame cannot be spun/rotated for some specified period of time (e.g., 10 seconds). This is in addition to scoring points for the hit. Similarly, if either of the front targets 194 is hit, the vehicle cannot be moved for a period of time. When the platform targets 193 are hit, not only are points scored, the vehicle will perform motions not controlled by the driver. In another example, when a single rider hits all three front (or back) targets, the vehicle they hit will flip and spin at the same time. If a rear target is hit, the hit vehicle stands the driver upside down and slowly spin him.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A vehicle, comprising:

a platform;

a seat frame rotatably suspended above the platform;

a passenger seat suspended above the platform within the seat frame;

vertically disposed supports disposed on opposite sides of a top surface of the platform, the seat frame being rotatably mounted on the vertically disposed supports such that the seat frame and the passenger seat are rotatable with respect to the vertically disposed supports;

a pair of drive tires positioned on the platform;

a pair of independent drive motors respectively connected to the pair of drive tires;

a seat frame disposed above the platform, wherein the passenger seat is rotatably supported within the seat frame; and a vehicle controller, mounted on the passenger seat, adapted to allow a user to control the vehicle to drive forward, drive backward and rotate up to 360°.

2. The vehicle according to claim 1, further comprising a transponder configured to receive operational control commands.

3. The vehicle according to claim 1, wherein the seat frame is configured to rotate 360°.

4. The vehicle according to claim 1, wherein the passenger seat is configured to be rotated and held in a variety of positions.

5. The vehicle according to claim 1, wherein the pair of drive tires are configured to move independently.

6. The vehicle according to claim 1, wherein the pair of drive tires are configured to move the vehicle forward, backward, or rotated.

7. The vehicle according to claim 1, wherein the pair of drive tires and the pair of independent drive motors are positioned below the top surface of the platform.

8. The vehicle according to claim 1, further comprising a vertical drive system separate from the pair of independent drive motors.

9. The vehicle according to claim 1, further comprising a laser gun mounted on the passenger seat.

10. The vehicle according to claim 1, wherein the vehicle comprises a plurality of vehicle mounted targets.

11. The vehicle according to claim 10, wherein the plurality of vehicle mounted targets comprises a rear target, a front target, and a platform target.

12. The vehicle according to claim 1, wherein said seat frame comprises:

a circular ring body surrounding the passenger seat;

cross beams extending across the circular ring body, the passenger seat being mounted to the cross beams within the circular ring body; and mounting bars mounting the seat frame mounted to each of the vertically disposed supports, the mounting bars forming an axis of rotation for the seat frame with respect to the vertically disposed supports.

13. The vehicle according to claim 1, further comprising a vertical drive system separate from the pair of independent drive motors, the vertical drive system configured to rotate the seat frame and the passenger seat up to 360° such that the passenger seat is able to flip and face forward, downward, upward and backward.

14. The vehicle according to claim 1, wherein the vehicle controller is configured to allow the user to control the vehicle to drive forward, drive backward and rotate 360° clockwise and counter clockwise such that the user may rotate the vehicle with the passenger seat in any position such that the passenger seat is simultaneously flipped while the vehicle is rotated.

15. The vehicle according to claim 1, wherein the seat frame comprises a circular ring body surrounding the passenger seat.

16. The vehicle according to claim 15, wherein the seat frame further comprises cross beams extending across the circular ring body, and wherein the passenger seat is mounted to the cross beams within the circular ring body.

17. The vehicle according to claim 1, wherein the seat frame is mounted to each of the vertically disposed supports by mounting bars, the mounting bars forming an axis of rotation for the seat frame with respect to the vertically disposed supports.

18. A vehicle, comprising:

a platform;

a seat frame rotatably suspended above the platform;

a passenger seat suspended above the platform within the seat frame;

vertically disposed supports disposed on opposite sides of a top surface of the platform, the seat frame being rotatably mounted on the vertically disposed supports such that the seat frame and the passenger seat are rotatable with respect to the vertically disposed supports;

a pair of drive tires positioned on the platform;

a pair of independent drive motors respectively connected to the pair of drive tires;

a seat frame disposed above the platform, wherein the passenger seat is supported within the seat frame;

a pair of vertical supports positioned on opposite sides of the platform;

a vertical drive system, disposed on one of the pair of vertical supports, the vertical drive system configured to rotate the seat frame; and a vehicle controller, mounted on the passenger seat, adapted to allow a user to control the vehicle to drive forward, drive backward and rotate up to 360°.

19. A vehicle, comprising:

a platform;

a seat frame rotatably suspended above the platform;

a passenger seat suspended above the platform within the seat frame;

vertically disposed supports disposed on opposite sides of a top surface of the platform, the seat frame being rotatably mounted on the vertically disposed supports such that the seat frame and the passenger seat are rotatable with respect to the vertically disposed supports;

a pair of drive tires positioned on the platform;

a pair of independent drive motors respectively connected to the pair of drive tires; and a ride controller adapted to allow a user to control the pair of independent drive motors and the pair of drive tires to drive the vehicle forward and backward.

* * * * *